US007235731B2

(12) United States Patent
Poff

(10) Patent No.: US 7,235,731 B2
(45) Date of Patent: Jun. 26, 2007

(54) STRAP FOR A STRINGED INSTRUMENT

(76) Inventor: Stephen W. Poff, 6409 Thoroughbred Loop, Odessa, FL (US) 33556

( * ) Notice: Subject to any disclaimer, the term of this patent is extended or adjusted under 35 U.S.C. 154(b) by 97 days.

(21) Appl. No.: 11/011,632

(22) Filed: Dec. 14, 2004

(65) Prior Publication Data

US 2006/0123972 A1 Jun. 15, 2006

(51) Int. Cl.
*G10D 3/00* (2006.01)

(52) U.S. Cl. ..... 84/327; 84/274

(58) Field of Classification Search ..... 84/327, 84/274, 278, 280; D17/14, 20
See application file for complete search history.

(56) References Cited

U.S. PATENT DOCUMENTS

| | | | | |
|---|---|---|---|---|
| 413,807 | A | 10/1889 | Loeser | |
| 491,372 | A | 2/1893 | Narberti | |
| 492,884 | A | 3/1893 | Boyer | |
| 950,873 | A | 3/1910 | Smith | |
| 1,275,291 | A | 8/1918 | Nelson | |
| 1,337,459 | A | 4/1920 | Lappalainen | |
| 2,489,321 | A | 11/1949 | Nyhagen | |
| 2,576,018 | A | 11/1951 | Johnson | |
| 3,136,197 | A | 6/1964 | Bried | |
| 3,366,293 | A * | 1/1968 | Fyke | 224/255 |
| 3,598,011 | A | 8/1971 | Henkle | |
| 3,822,628 | A | 7/1974 | Quemore, Sr. | |
| 3,964,362 | A | 6/1976 | Quemore, Sr. | |
| 4,188,851 | A * | 2/1980 | Wolf | 84/327 |
| 4,389,916 | A | 6/1983 | Ruthstrom | |
| 4,765,219 | A | 8/1988 | Alm | |
| 4,913,027 | A | 4/1990 | Twohy | |
| 5,528,971 | A | 6/1996 | Wood | |
| 5,780,756 | A * | 7/1998 | Babb | 84/280 |
| 5,868,293 | A * | 2/1999 | D'Addario et al. | 224/257 |
| 6,239,337 | B1 * | 5/2001 | Stein | 84/279 |
| 6,504,087 | B2 | 1/2003 | Shulman | |

* cited by examiner

*Primary Examiner*—Lincoln Donovan
*Assistant Examiner*—Jianchun Qin

(57) ABSTRACT

A strap for holding a stringed instrument around the neck of a musician. The strap includes a stop disposed at a distal end for engagement with the instrument, between the instrument's face and finger board, substantially adjacent the instrument's neck and neck heel, such that the instrument may be safely and securely held around the musician's neck without regard to whether the instrument is in a "rest" or a "performance" position.

9 Claims, 3 Drawing Sheets

STRAP FOR A STRINGED INSTRUMENT

BACKGROUND OF THE INVENTION

1. Field of the Invention

The present invention relates to a strap for a stringed instrument used by a musician intending to play that instrument whereby the strap safely and securely holds the instrument around the musician's neck. As is set forth in detail below, the strap of this invention is preferably used in combination with a violin or a viola, but it is believed that apparent modifications could be made so that the strap of this invention is suitable for use with other stringed instruments intended to be held around the musician's neck.

2. Description of the Prior Art

Numerous holding devices are shown in prior patent literature for assisting a musician in holding a stringed instrument, particularly instruments in the violin family. However, most such prior art devices require substantially permanent attachment of at least an element of the holding means to the instrument. Not only may this affect the quality of sound produced by the instrument, but also it may actually hinder a comfortable positioning of the instrument for playing by the musician. While perhaps considered a relatively minor inconvenience, many prior art holding devices would require their removal before the instrument could be properly secured in its carrying case. Finally, using the devices shown in the prior art, while there is assistance to the musician in placing the instrument in a playing position, many of the prior art devices would permit the instrument to fall if it were not held by the musician in either a playing or non-playing position. That is to say, many current instrument holders for stringed instruments do not permit the musician to release the instrument while still securely and safely protecting the instrument from fall.

It is therefore clear that a need remains for a strap that is attachable to a stringed instrument so as to assist in holding the instrument in a proper playing position, while safely retaining the instrument in the event that it is released by the musician. Such a device should be adaptable to a variety of sizes of stringed instruments, should be easily attached and removed, and must not interfere with either playing the instrument or the quality of sound produced by the instrument.

SUMMARY OF THE INVENTION

The present invention relates to a strap used in combination with a stringed instrument having a face, a finger board, an instrument neck and neck heel, whereby the instrument may be supported around the neck of the musician. The strap is adjustable to fit around the musician's neck and includes an instrument cord extending from the strap. Disposed at the distal end of the instrument cord is a stop which is received between the face of the instrument and the instrument's finger board whereby the instrument will be held by the strap and the cord by virtue of engagement of the stop with the instrument as described above. The stop engages the instrument in a manner that does not interfere with the quality of sound produced when the instrument is played, and the exterior, instrument-engaging surface of the stop is chosen from a material so that it does not damage the finish of the instrument.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawing.

DETAILED DESCRIPTION

Figure 1:
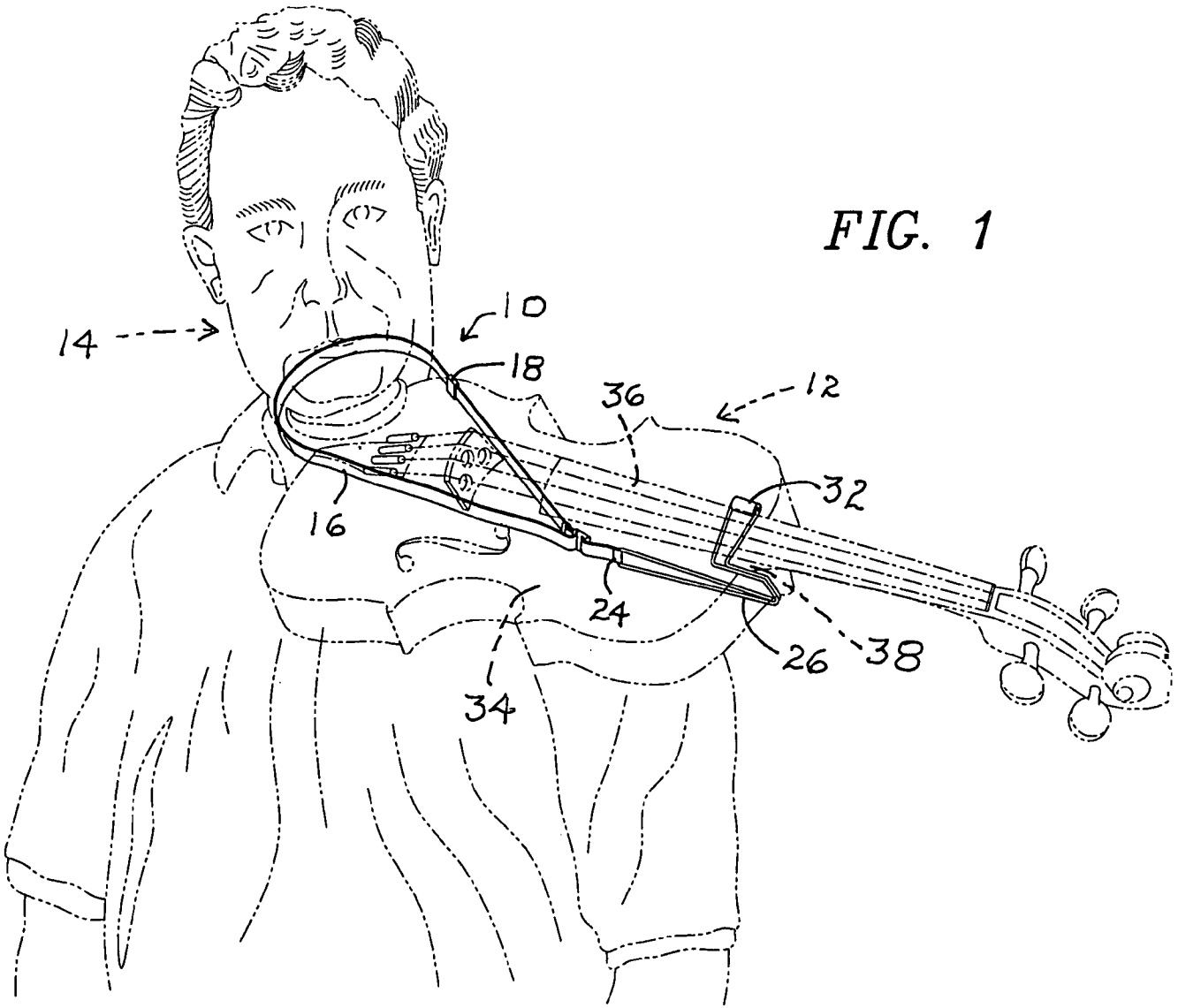
FIG. 1 illustrates a preferred embodiment of the strap operatively attached to a violin and around the neck of a musician, with the violin and the musician shown in phantom.
Figure 2:
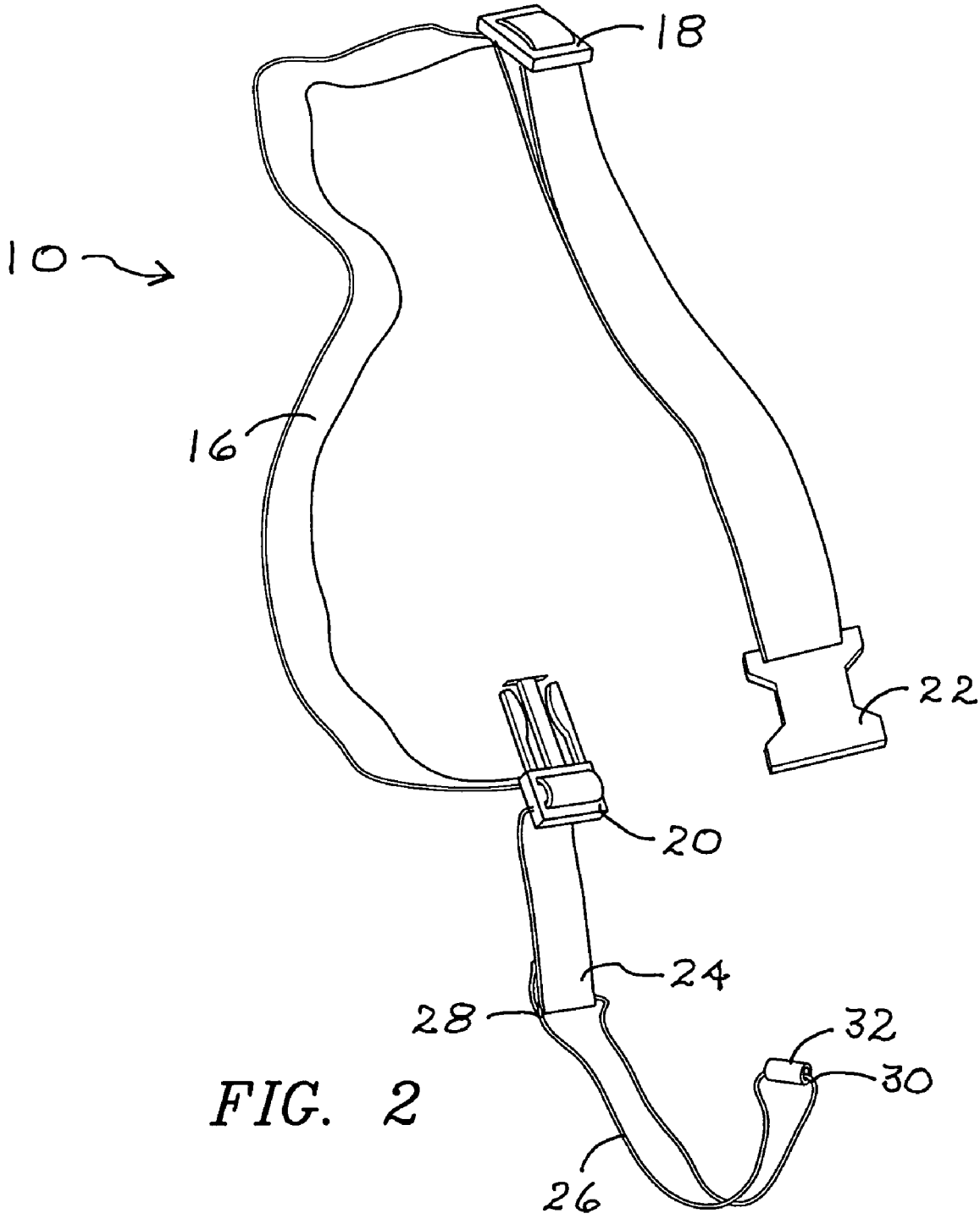
FIG. 2 is a perspective view of a preferred embodiment of the strap.
Figure 3:
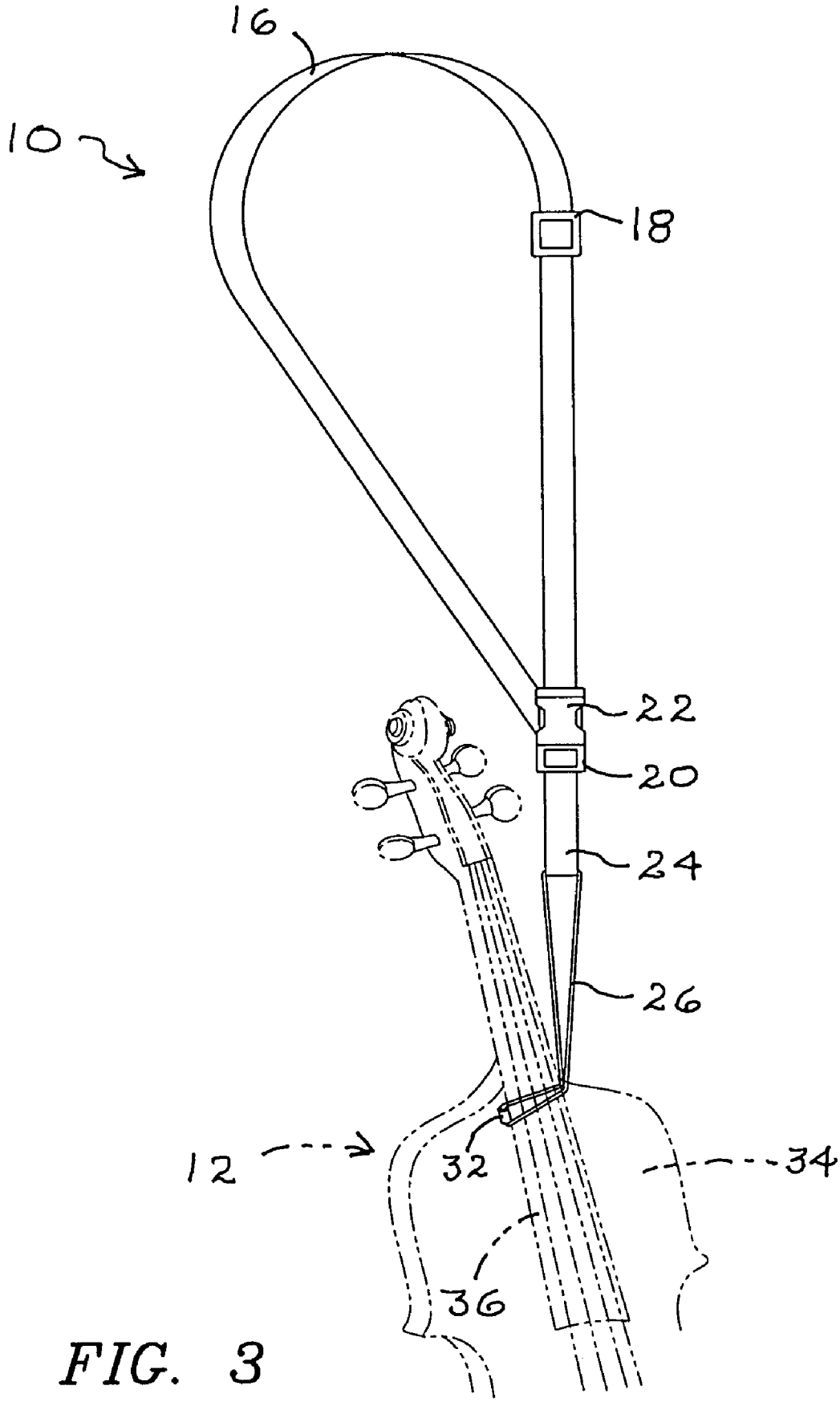
FIG. 3 is a perspective view of the preferred embodiment of the strap supporting a violin, shown in phantom, in a non-playing position.

A preferred embodiment for the strap of this invention is generally indicated as 10 in each of the drawing FIGS. 1-3. In the view of FIG. 1, strap 10 is illustrated as being operatively attached to the instrument, generally indicated as 12 around the neck of a musician generally indicated as 14. Of course, instrument 12 and musician 14 are illustrated in phantom only. It is also to be noted and remembered that in the following detailed description a preferred embodiment for strap 10 is provided. As will be noted hereinafter, modifications of this preferred embodiment for strap 10 may be made without departing from the scope of the protected invention.

Turning to the more detailed view of FIG. 2, it can be seen that this embodiment of strap 10 comprises a band 16 that is dimensioned and configured to encircle the neck of the musician 14, as shown in the view of FIG. 1. The length of band 16 may be adjusted through the use of adjuster 18, and the band may be closed by inserting first buckle member 20 into second buckle member 22. In this preferred embodiment, first buckle member 20 and second buckle member 22 are typically referred to as a "bayonet buckle." Band 16 further comprises a distal band end 24 that is not included within the portion of band 16 which passes around the neck of musician 14. As can be clearly seen in the view of FIG. 2, the placement of first buckle member 20 onto band 16 is adjustable, and distal band end 24 extends outwardly from first buckle member 20.

An instrument cord generally indicated as 26 extends from distal band end 24, and instrument cord 26 includes a first cord end 28 that is attached to distal band end 24. Opposite first cord end 28 is cord distal end 30, and a stop 32 is attached to cord distal end 30.

According to the preferred embodiment for strap 10 shown in the view of FIG. 2, instrument cord 26 is a loop with one segment of the loop defining first cord end 28 and a remote section of the loop defining cord distal end 30. Stop 32 is depicted as a substantially tubular member disposed at the loop defining cord distal end 30. It is to be understood that modification of strap 10 such that the instrument cord was defined by a single length of material having one end attached to distal band end 24 and structure corresponding to stop 32 attached at its other end is encompassed within the scope of this invention. It is also to be understood that alternate, well-known substitutes for the illustrated adjuster 18 and first buckle member 20 and second buckle member 22 may also be substituted, for the figures depict only a preferred embodiment for strap 10 of this invention. In addition, band 16 is preferably formed from a woven strap material, but the scope of the present invention is not to be limited to any particular material for the construction of band 16. However, band 16 and instrument cord 26 must possess sufficient flexibility for use, as depicted in the view of FIG. 1. While this preferred embodiment for strap 10 is illustrated for use in combination with an instrument 12 shown as a violin, it certainly is to be understood that the preferred embodiment for strap 10 could also be used with a viola. In fact, the strap of this invention, it is believed, could be modified for use with a variety of stringed instruments that may be supported from the neck of a musician.

Turning to the view of FIG. 3, one can see that the primary attachment of strap 10 to instrument 12 is accomplished by passing a segment of instrument cord 26 into the gap defined between instrument face 34 and finger board 36 such that stop 32 is wedged therein substantially adjacent instrument neck and neck heel 38, partially visible in the view of FIG. 1. Then, as shown in the view of FIG. 1 with band 16 encircling the neck of musician 14, strap 10 is positioned beneath instrument 12 so that it may be held in a playing position as illustrated. It is to be noted that in the view of FIG. 1, it is clearly shown that strap 10 will support instrument 12 without use of either hand of musician 14. Referring to the view of FIG. 3, even though no musician is shown, if band 16 were around the neck of a musician, instrument 12 would safely and securely hang without danger of falling to the support surface.

With particular regard to stop 32, inasmuch as the outer surface of stop 32 does engage at least portions of instrument 12, in this preferred embodiment for strap 10, the outer surface of stop 32 is formed from a non-marring material such as, for example, leather, felt, cork, soft plastic, or virtually any other material having a substantially soft, non-marring quality.

It will thus be seen that the objects set forth above, among those made apparent from the preceding description, are efficiently obtained, and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A strap for a stringed instrument selected from the group consisting of violins and violas, the stringed instrument having a face, a finger board, a gap between the face and the finger board, a neck and neck heel whereby the instrument is supported around the neck of a musician by said strap, said strap comprising: a band dimensioned and configured to encircle the neck of the musician intending to play the instrument, said band comprising a distal band end; an instrument cord comprising a first cord end attached to said distal band end and extending therefrom to a cord distal end; and a stop attached to said cord distal end, said cord distal end being dimensioned and configured to be received in the gap between the face of the instrument and the finger board of the instrument substantially adjacent the neck and neck heel of the instrument, and said stop engaging the face and the finger board to retain said cord distal end in the gap, whereby the instrument is held around the musician's neck.

2. A strap as in claim 1 wherein said stop comprises a non-marring outer surface and is dimensioned to be larger than the gap between the face and the finger board.

3. A strap as in claim 2 wherein said outer surface is leather.

4. A strap as in claim 2 wherein said outer surface is cork.

5. A strap as in claim 2 wherein said outer surface is felt.

6. A strap as in claim 1 wherein said band is adjustable.

7. A strap as in claim 6 wherein said band further comprises a buckle, said buckle comprising a first buckle member and a second buckle member, and said band further comprises a first band end and a second band end, said first buckle member being attached to said first band end and said second buckle member being attached to said second band end, whereby said first buckle member and said second buckle member are removably attachable one to the other to hold said strap around the musician's neck.

8. A strap as in claim 1 wherein said cord comprises a loop of flexible material, one segment of said loop being attached to said distal band end, said stop being attached to said cord distal end that is defined by a second segment of said loop.

9. A strap for a stringed instrument selected from the group consisting of violins and violas, the stringed instrument having a face, a finger board, a gap between the face and the finger board, and an instrument neck and neck heel whereby the instrument is supported around the neck of a musician by said strap, said strap comprising: an adjustable band dimensioned and configured to encircle the neck of the musician intending to play the instrument, said band comprising a distal band end, said band further comprising a buckle, said buckle comprising a first buckle member and a second buckle member, and said band further comprising a first band end and a second band end, said first buckle member being attached to said first band end and said second buckle member being attached to said second band end, whereby said first buckle member and said second buckle member are removably attachable one to the other to hold said strap around the musician's neck; said strap further comprising an instrument cord comprising a loop of flexible material, one segment of said loop being attached to said distal band end and another segment of said loop defining a cord distal end; and said strap further comprising a stop attached to said cord distal end, said stop comprising a non-marring outer surface and said cord distal end being dimensioned and configured to be received in the gap between the face of the instrument and the finger board of the instrument substantially adjacent the neck and neck heel of the instrument, and said stop engaging the face and the finger board to retain said cord distal end in the gap, whereby the instrument is held around the musician's neck.

* * * * *